US010635018B2

(12) United States Patent
Kanai et al.

(10) Patent No.: US 10,635,018 B2
(45) Date of Patent: Apr. 28, 2020

(54) IMAGE FORMING APPARATUS HAVING A PLURALITY OF MODES DIFFERENT IN BACKGROUND POTENTIAL DIFFERENCE

(71) Applicant: CANON KABUSHIKI KAISHA, Tokyo (JP)

(72) Inventors: Ryosuke Kanai, Kawasaki (JP); Seiichi Shinohara, Mishima (JP); Kuniaki Tamagaki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/282,830

(22) Filed: Feb. 22, 2019

(65) Prior Publication Data

US 2019/0265606 A1 Aug. 29, 2019

(30) Foreign Application Priority Data

Feb. 26, 2018 (JP) ..... 2018-031888

(51) Int. Cl.
*G03G 15/04* (2006.01)
*G03G 15/043* (2006.01)
*G03G 15/047* (2006.01)

(52) U.S. Cl.
CPC ..... *G03G 15/043* (2013.01); *G03G 15/047* (2013.01)

(58) Field of Classification Search
CPC ..... G03G 15/043; G03G 15/047; G03G 2215/0495; H04N 1/2369; H04N 1/407; G06K 15/1209; G06K 15/1223
USPC ..... 399/51; 347/253
See application file for complete search history.

(56) References Cited

U.S. PATENT DOCUMENTS 5,146,281 A 9/1992 Kisu
6,104,419 A * 8/2000 Sato ..... H04N 1/40037 347/133
9,041,757 B2 * 5/2015 Hayakawa ..... G03G 15/80 347/237
9,606,472 B2 * 3/2017 Fujii ..... G03G 15/043
(Continued)

FOREIGN PATENT DOCUMENTS

JP H05107868 A 4/1993
JP H05127500 A 5/1993
(Continued)

*Primary Examiner* — Robert B Beatty
(74) *Attorney, Agent, or Firm* — Rossi, Kimms & McDowell LLP

(57) ABSTRACT

An image forming apparatus includes: an image bearing member to rotate; a charging member to charge a surface of the image bearing member; a charging voltage applying portion to apply an alternating-current voltage having a predetermined charging frequency to the charging member; and an exposing portion to perform image exposure and background exposure. A plurality of modes are settable for the image forming apparatus, and the plurality of image forming modes include image forming modes different in a background potential difference which is a potential difference between a surface potential of the image bearing member after the surface of the image bearing member is charged and before the charged surface is exposed by the exposing portion and a surface potential of a portion of the surface of the image bearing member which has been subjected to the background exposure.

10 Claims, 9 Drawing Sheets

(56) References Cited

U.S. PATENT DOCUMENTS

| | | | | |
|---|---|---|---|---|
| 9,632,450 | B2 * | 4/2017 | Shiomichi | G03G 15/04036 |
| 2015/0277267 | A1 * | 10/2015 | Okubo | G03G 15/043<br>347/118 |
| 2019/0129325 | A1 * | 5/2019 | Todokoro | G02B 26/127 |
| 2019/0163087 | A1 * | 5/2019 | Ishida | G03G 15/043 |

FOREIGN PATENT DOCUMENTS

| | | | |
|---|---|---|---|
| JP | H0789249 | B2 | 9/1995 |
| JP | 2000147846 | A | 5/2000 |
| JP | 2014013373 | A | 1/2014 |

* cited by examiner

*FIG.1*

| | PRINT MODE | Vp [mm/s] | D [dpi] | fp [Hz] | MOIRE PITCH [mm] AT (N+n)-DOT IMAGE PERIODS | | | | | MAXIMUM MOIRE PITCH PMAX [mm] | LIGHT AMOUNT E1 [μJ/cm²] | V0 [V] | Vd [V] | Va [V] | MOIRE IMAGE | CHARGING SOUND | DRUM OPTICAL FATIGUE |
|---|---|---|---|---|---|---|---|---|---|---|---|---|---|---|---|---|---|
| | | | | | 2 | 3 | 4 | 5 | 6 | | | | | | | | |
| FIRST EMBODIMENT | MODE A | 165 | 600 | 1680 | 0.61 | 0.43 | 0.23 | 0.18 | 0.16 | 0.61 | 0 | -500 | -500 | 0 | ○ | ○ | ○ |
| | MODE B | 165 | 900 | 1680 | 0.13 | 0.61 | 0.76 | 0.32 | 0.23 | 0.76 | 0.05 | -575 | -500 | 75 | ○ | ○ | |
| | MODE C | 165 | 1200 | 1680 | 0.07 | 0.18 | 0.61 | 1.36 | 0.43 | 1.36 | 0.10 | -650 | -500 | 150 | ○ | ○ | |
| COMPARATIVE EXAMPLE B | MODE A | 165 | 600 | 1680 | 0.61 | 0.43 | 0.23 | 0.18 | 0.16 | 0.61 | 0 | -500 | -500 | 0 | ○ | ○ | ○ |
| | MODE B | 165 | 900 | 1680 | 0.13 | 0.61 | 0.76 | 0.32 | 0.23 | 0.76 | 0 | -500 | -500 | 0 | × | ○ | |
| | MODE C | 165 | 1200 | 1680 | 0.07 | 0.18 | 0.61 | 1.36 | 0.43 | 1.36 | 0 | -500 | -500 | 0 | × | ○ | |
| COMPARATIVE EXAMPLE C | MODE A | 165 | 600 | 1680 | 0.61 | 0.43 | 0.23 | 0.18 | 0.16 | 0.61 | 0 | -500 | -500 | 0 | ○ | ○ | ○ |
| | MODE B | 165 | 900 | 2520 | 0.41 | 0.29 | 0.16 | 0.12 | 0.11 | 0.41 | 0 | -500 | -500 | 0 | ○ | × | |
| | MODE C | 165 | 1200 | 3360 | 0.31 | 0.22 | 0.12 | 0.09 | 0.08 | 0.31 | 0 | -500 | -500 | 0 | ○ | × | |
| COMPARATIVE EXAMPLE D | MODE A | 165 | 600 | 1680 | 0.61 | 0.43 | 0.23 | 0.18 | 0.16 | 0.61 | 0.10 | -650 | -500 | 150 | ○ | ○ | × |
| | MODE B | 165 | 900 | 1680 | 0.13 | 0.61 | 0.76 | 0.32 | 0.23 | 0.76 | 0.10 | -650 | -500 | 150 | ○ | ○ | |
| | MODE C | 165 | 1200 | 1680 | 0.07 | 0.18 | 0.61 | 1.36 | 0.43 | 1.36 | 0.10 | -650 | -500 | 150 | ○ | ○ | |

MOIRE IMAGE … ○ : NO MOIRE IMAGE WAS FORMED
× : MOIRE IMAGE WAS FORMED

CHARGING SOUND … ○ : NO ANNOYING SOUND WAS GENERATED
× : ANNOYING SOUND WAS GENERATED

DRUM OPTICAL FATIGUE … ○ : DENSITY WAS RETAINED AFTER CONSECUTIVE PRINTING
× : DENSITY WAS REDUCED AFTER CONSECUTIVE PRINTING

*FIG.7*

| | PRINT MODE | Vp [mm/s] | D [dpi] | fp [Hz] | MOIRE PITCH [mm] AT (N+n)-DOT IMAGE PERIODS | | | | | MAXIMUM MOIRE PITCH PMAX [mm] | LIGHT AMOUNT E1 [μJ/cm²] | V0 [V] | Vd [V] | Va [V] | MOIRE IMAGE | CHARGING SOUND | DRUM OPTICAL FATIGUE |
|---|---|---|---|---|---|---|---|---|---|---|---|---|---|---|---|---|---|
| | | | | | 2 | 3 | 4 | 5 | 6 | | | | | | | | |
| SECOND EMBODIMENT | MODE A | 165 | 600 | 1680 | 0.61 | 0.43 | 0.23 | 0.18 | 0.16 | 0.61 | 0 | -500 | -500 | 0 | ○ | ○ | ○ |
| | MODE G | 248 | 400 | 1680 | 0.91 | 0.66 | 0.35 | 0.28 | 0.24 | 0.91 | 0.07 | -600 | -500 | 100 | ○ | ○ | |
| | MODE H | 330 | 300 | 1680 | 1.23 | 0.87 | 0.47 | 0.37 | 0.32 | 1.23 | 0.10 | -650 | -500 | 150 | ○ | ○ | |
| COMPARATIVE EXAMPLE G | MODE A | 165 | 600 | 1680 | 0.61 | 0.43 | 0.23 | 0.18 | 0.16 | 0.61 | 0 | -500 | -500 | 0 | ○ | ○ | ○ |
| | MODE G | 248 | 400 | 1680 | 0.91 | 0.66 | 0.35 | 0.28 | 0.24 | 0.91 | 0 | -500 | -500 | 0 | × | ○ | |
| | MODE H | 330 | 300 | 1680 | 1.23 | 0.87 | 0.47 | 0.37 | 0.32 | 1.23 | 0 | -500 | -500 | 0 | × | ○ | |
| COMPARATIVE EXAMPLE H | MODE A | 165 | 600 | 1680 | 0.61 | 0.43 | 0.23 | 0.18 | 0.16 | 0.61 | 0 | -500 | -500 | 0 | ○ | ○ | ○ |
| | MODE G | 248 | 400 | 2520 | 0.44 | 0.20 | 0.16 | 0.14 | 0.13 | 0.44 | 0 | -500 | -500 | 0 | ○ | × | |
| | MODE H | 330 | 300 | 3360 | 0.23 | 0.16 | 0.14 | 0.13 | 0.12 | 0.23 | 0 | -500 | -500 | 0 | ○ | × | |
| COMPARATIVE EXAMPLE J | MODE A | 165 | 600 | 1680 | 0.61 | 0.43 | 0.23 | 0.18 | 0.16 | 0.61 | 0.10 | -650 | -500 | 150 | ○ | ○ | × |
| | MODE B | 248 | 400 | 1680 | 0.91 | 0.66 | 0.35 | 0.28 | 0.24 | 0.91 | 0.10 | -650 | -500 | 150 | ○ | ○ | |
| | MODE H | 330 | 300 | 1680 | 1.23 | 0.87 | 0.47 | 0.37 | 0.32 | 1.23 | 0.10 | -650 | -500 | 150 | ○ | ○ | |

MOIRE IMAGE … ○ : NO MOIRE IMAGE WAS FORMED
× : MOIRE IMAGE WAS FORMED

CHARGING SOUND … ○ : NO ANNOYING SOUND WAS GENERATED
× : ANNOYING SOUND WAS GENERATED

DRUM OPTICAL FATIGUE … ○ : DENSITY WAS RETAINED AFTER CONSECUTIVE PRINTING
× : DENSITY WAS REDUCED AFTER CONSECUTIVE PRINTING

*FIG.8*

| | PRINT MODE | Vp [mm/s] | fp [Hz] | fd [Hz] | MOIRE PITCH [mm] | | | | MAXIMUM MOIRE PITCH PMAX [mm] | LIGHT AMOUNT E1 [μJ/cm²] | V0 [V] | Vd [V] | Va [V] | MOIRE IMAGE | DRUM OPTICAL FATIGUE |
|---|---|---|---|---|---|---|---|---|---|---|---|---|---|---|---|
| | | | | | m=1 | m=2 | m=3 | m=4 | | | | | | | |
| THIRD EMBODIMENT | MODE S | 185 | 1450 | 2500 | 0.18 | 0.46 | 0.10 | 0.06 | 0.61 | 0 | -500 | -500 | 0 | ○ | ○ |
| | MODE T | 185 | 1450 | 2650 | 0.15 | 0.74 | 0.11 | 0.06 | 0.91 | 0.05 | -600 | -500 | 75 | ○ | |
| | MODE U | 185 | 1450 | 2750 | 0.14 | 1.23 | 0.12 | 0.06 | 1.23 | 0.10 | -650 | -500 | 150 | ○ | |
| COMPARATIVE EXAMPLE G | MODE S | 185 | 1450 | 2500 | 0.18 | 0.46 | 0.10 | 0.06 | 0.61 | 0 | -500 | -500 | 0 | ○ | ○ |
| | MODE T | 248 | 1450 | 2650 | 0.15 | 0.74 | 0.11 | 0.06 | 0.91 | 0 | -500 | -500 | 0 | × | |
| | MODE U | 185 | 1450 | 2750 | 0.14 | 1.23 | 0.12 | 0.06 | 1.23 | 0 | -500 | -500 | 0 | × | |
| COMPARATIVE EXAMPLE H | MODE S | 165 | 1450 | 2500 | 0.18 | 0.46 | 0.10 | 0.06 | 0.61 | 0 | -500 | -500 | 0 | ○ | ○ |
| | MODE T | 185 | 1450 | 2650 | 0.15 | 0.74 | 0.11 | 0.06 | 0.44 | 0 | -500 | -500 | 0 | ○ | |
| | MODE U | 185 | 1450 | 2750 | 0.14 | 1.23 | 0.12 | 0.06 | 0.23 | 0 | -500 | -500 | 0 | ○ | |

MOIRE IMAGE … ○ : NO MOIRE IMAGE WAS FORMED
× : MOIRE IMAGE WAS FORMED

DRUM OPTICAL FATIGUE … ○ : DENSITY WAS RETAINED AFTER CONSECUTIVE PRINTING
× : DENSITY WAS REDUCED AFTER CONSECUTIVE PRINTING

IMAGE FORMING APPARATUS HAVING A PLURALITY OF MODES DIFFERENT IN BACKGROUND POTENTIAL DIFFERENCE

BACKGROUND OF THE INVENTION

Field of the Invention

The present disclosure relates to an electrophotographic image forming apparatus.

Description of the Related Art

Existing examples of an electrophotographic image forming apparatus include an electrophotographic copying machine, an electrophotographic printer (such as an LED printer or a laser beam printer), and an electrophotographic facsimile machine.

In an image forming apparatus of this type, a surface of an electrophotographic photosensitive member (hereinafter referred to as the photosensitive drum or the drum) is uniformly charged using a charging device, and the charged surface of the photosensitive drum is exposed to light using a latent image exposing device to form an electrostatic latent image. Then, the electrostatic latent image is developed using a developing device to form a developer (hereinafter referred to as toner) image, and a toner image as the developer image is transferred to a transfer material using a transfer device. Subsequently, using a fixing device, the toner image is fixed as a permanently fixed image onto the transfer material to be output. After the transfer of the toner image, using a cleaning device, the untransferred toner remaining on the surface of the photosensitive drum is removed therefrom to thus clean the photosensitive drum and allow the photosensitive drum to be prepared for the next image forming operation.

Charging means of a contact charging type are mounted in a large number of image forming apparatus to become mainstream charging means. Most of the contact charging means use roller charging in which voltages are applied to conductive rollers. Among roller charging methods, there is an AC charging method which superimposes an alternating-current voltage on a direct-current voltage and applies the resulting voltage. The AC charging method repeatedly discharges a photosensitive drum to converge a surface potential of the photosensitive drum to the potential of the direct-current voltage and therefore has high uniform charging performance.

As developing means, a jumping developing method is known in which a photosensitive drum and a developing sleeve are disposed in non-contact relation, and a voltage obtained by superimposing an alternating-current voltage on a direct-current voltage is applied to the developing sleeve to allow development to be performed.

It is generally known that, when the AC charging method is used, the problems of the interference between an image frequency and a charging frequency and the interference between the charging frequency and a developing frequency arise, and it is proposed to inhibit such interference.

Japanese Examined Patent Publication No. H07-89249 describes inhibiting the interference between the image frequency and the charging frequency, while Japanese Patent Application Laid-open No. 2000-147846 describes inhibiting the interference between the charging frequency and the developing frequency. Japanese Examined Patent Publication No. H07-89249 describes setting the relationship between the image frequency and the charging frequency such that no defective image is formed, while Japanese Patent Application Laid-open No. 2000-147846 describes setting the relationship between the charging frequency and the developing frequency such that no defective image is formed.

On the other hand, Japanese Examined Patent Publication No. H05-107868 describes a background exposure technique. Background exposure refers to a configuration in which, after charging using a charging member, a photosensitive drum potential Vd at a non-image portion as a white background portion in an image is formed by performing weak exposure using an exposing device. By performing the background exposure, it is possible to inhibit slight fluctuations in photosensitive drum potential resulting from the AC charging and inhibit a defective image resulting from the interference.

SUMMARY OF THE INVENTION

However, particularly in the case of an image forming apparatus which forms images in various print modes, the following problem arises. Specifically, it is difficult in most cases to set each of the image frequency, the charging frequency, and the developing frequency in each of the print modes so as to prevent the formation of a defective image due to the interference and satisfy other qualities relating to a charging sound, fogging and the like.

On the other hand, in a configuration which sets each of the frequencies so as to satisfy qualities relating to the charging sound, fogging and the like, and inhibits the interference using the background exposure, a problem arises in the optical fatigue of a photosensitive drum. In other words, the background exposure has a problem in outputting stable images over a long-term use. Since exposure is performed not only on the image portion as a black letter portion in an image, but also on the non-image portion as a white background portion in the image, the photosensitive drum undergoes significant optical fatigue when used for a long period of time. When the photosensitive drum has undergone the optical fatigue, the sensitivity of the photosensitive drum deteriorates so that a post-exposure photosensitive drum potential is close to a post-charging potential. This results in a problem such as a reduced developing contrast potential or a reduced image density.

It is therefore an object of the present disclosure to provide an image forming apparatus capable of more reliably inhibiting the optical fatigue of an image bearing member and outputting stable images for a long period, while inhibiting the interference between an image frequency and a charging frequency or between the image frequency and a developing frequency.

In order to achieve the object described above, an image forming apparatus according to an embodiment of the present disclosure includes:

an image bearing member configured to rotate at a predetermined moving speed;

a charging member configured to charge a surface of the image bearing member;

a charging voltage applying portion configured to apply an alternating-current voltage having a predetermined charging frequency to the charging member; and an exposing portion configured to perform image exposure in which a first region of the surface of the image bearing member charged by the charging member is exposed at a first exposure amount for forming an image portion potential, perform background exposure in which a second region of the surface of the image bearing member is exposed at a second exposure amount for forming a non-image portion potential and form an electrostatic latent image at a predetermined resolution on the image bearing member, the second exposure amount being lower than the first exposure amount, wherein a plurality of image forming modes are settable for the image forming apparatus, the plurality of image forming modes are different in at least one of the resolution, the moving speed, and the charging frequency, and the plurality of image forming modes include image forming modes different in a background potential difference which is a potential difference between a surface potential of the image bearing member after the surface of the image bearing member is charged and before the charged surface is exposed by the exposing portion and a surface potential of a portion of the surface of the image bearing member which has been subjected to the background exposure.

In order to achieve the object described above, an image forming apparatus according to an embodiment of the present disclosure includes:

an image bearing member configured to convey an electrostatic latent image borne thereon at a predetermined moving speed;

a charging member configured to charge a surface of the image bearing member;

a charging voltage applying portion configured to apply an alternating-current voltage having a predetermined charging frequency to the charging member;

a developer bearing member configured to convey a developer borne thereon;

a developing voltage applying portion configured to apply an alternating-current voltage having a predetermined developing frequency to the developer bearing member; and an exposing portion configured to perform image exposure in which a first region of the surface of the image bearing member charged by the charging member is exposed at a first exposure amount for forming an image portion potential and perform background exposure in which a second region of the surface of the image bearing member is exposed at a second exposure amount for forming a non-image portion potential, the second exposure amount being lower than the first exposure amount, wherein a plurality of image forming modes are settable for the image forming apparatus, the plurality of image forming modes are different in either one of the charging frequency and the developing frequency, and the plurality of image forming modes include image forming modes different in a background potential difference which is a potential difference between a surface potential of the image bearing member after the surface of the image bearing member is charged and before the charged surface is exposed by the exposing portion and a surface potential of a portion of the surface of the image bearing member which has been subjected to the background exposure.

According to the present disclosure, it is possible to provide an image forming apparatus capable of more reliably inhibiting the optical fatigue of an image bearing member and outputting stable images for a long period, while inhibiting the interference between an image frequency and a charging frequency or between the image frequency and a developing frequency.

Further features of the present disclosure will become apparent from the following description of exemplary embodiments with reference to the attached drawings.

BRIEF DESCRIPTION OF THE DRAWINGS

FIG. 1 is a table of various modes according to a first embodiment of the present disclosure;

FIG. 7 is a table of various modes according to a second embodiment of the present disclosure; and FIG. 8 is a table of various modes according to a third embodiment of the present disclosure.

DESCRIPTION OF THE EMBODIMENTS

Figure 2:
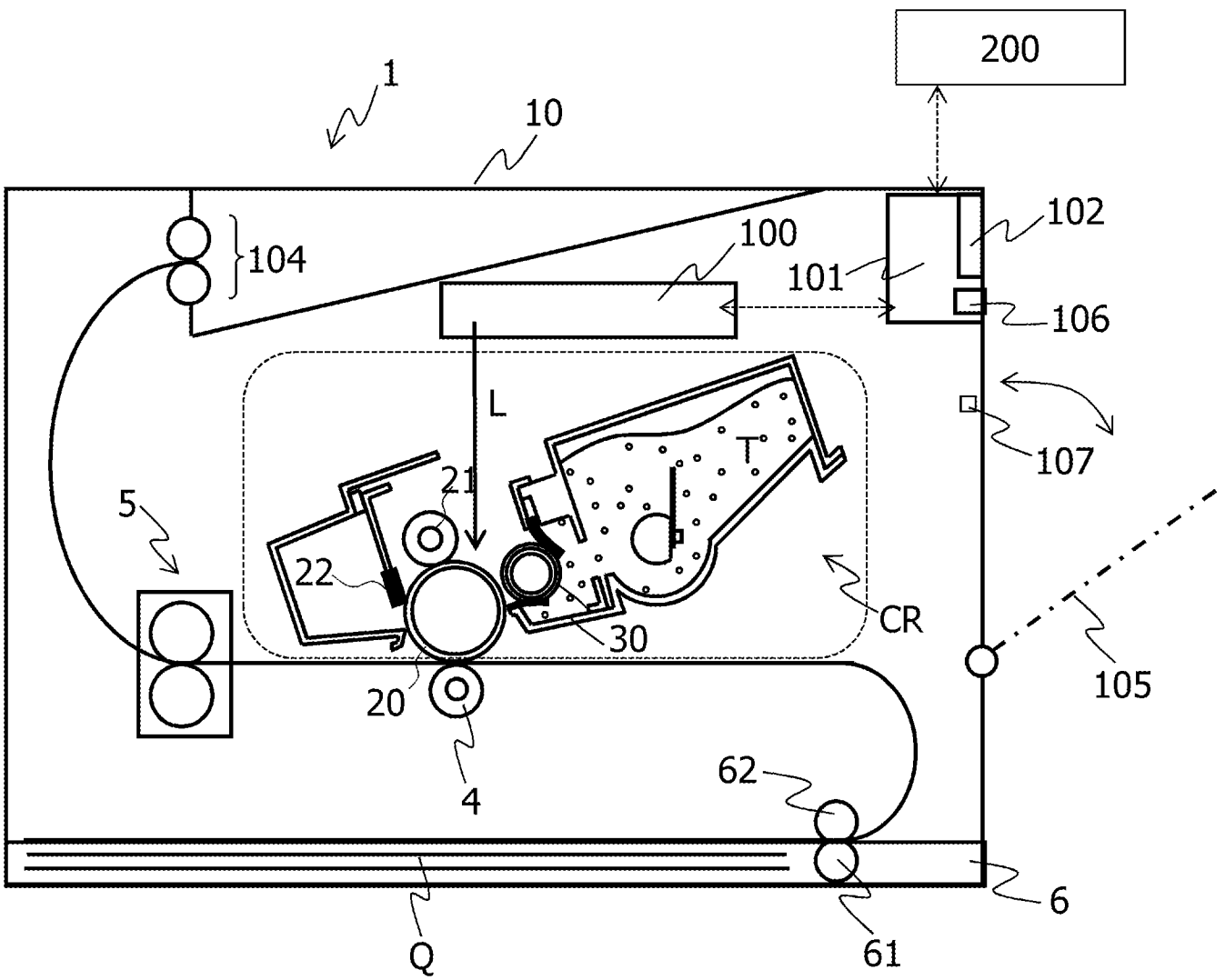
FIG. 2 is a cross-sectional view of an image forming apparatus according to the present disclosure.

Referring to the drawings, the following will illustratively describe forms for carrying out this disclosure on the basis of the embodiments thereof. However, the dimensions, materials, shapes, and relative positioning of the components described in the embodiments and the like are to be appropriately changed in accordance with a configuration of an apparatus to which the disclosure is applied and various conditions, and are not intended to limit the scope of the disclosure to the following embodiments.

First Embodiment

The following will describe a first embodiment of the present disclosure in detail on the basis of the drawings.

Figure 3:
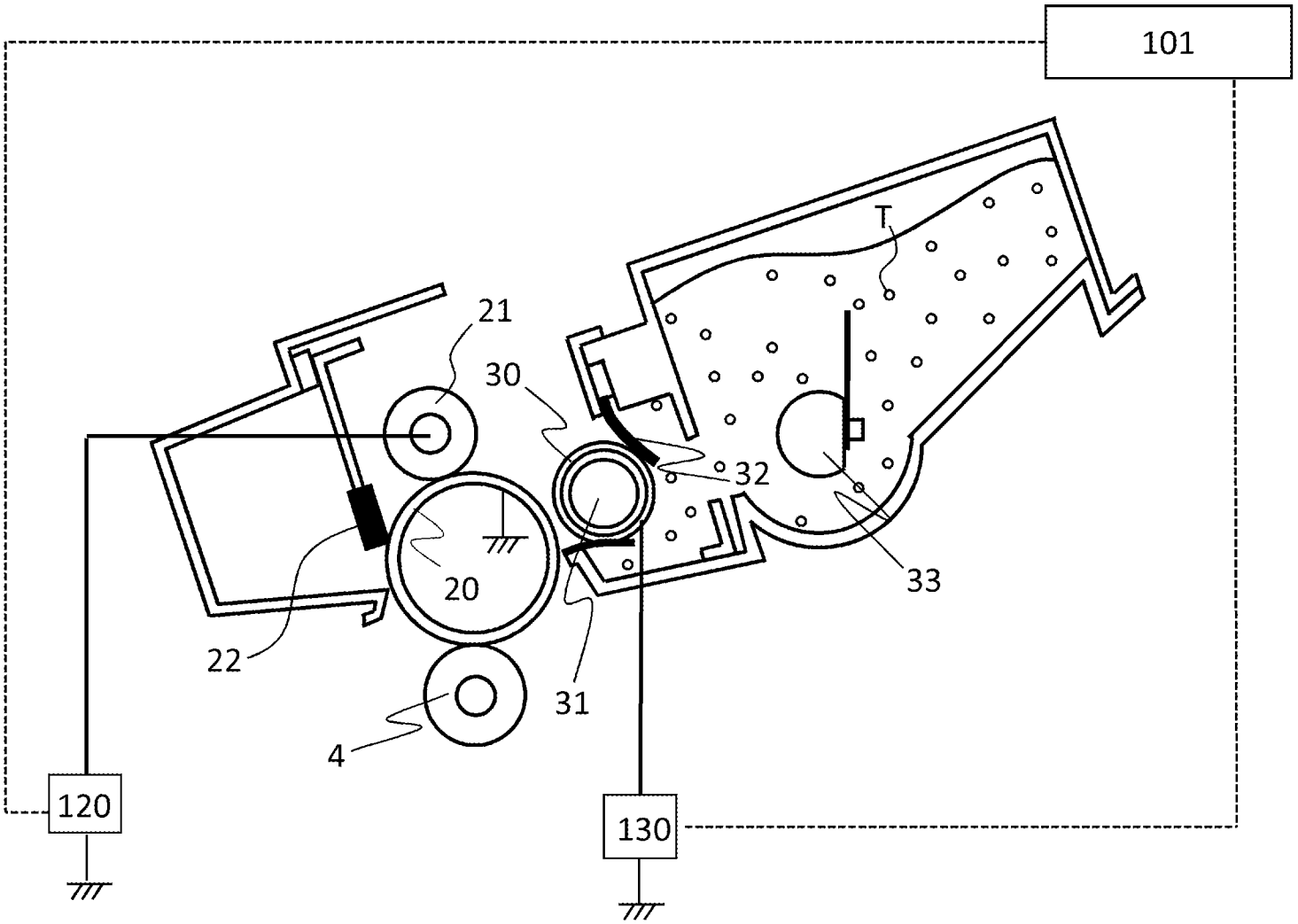
FIG. 3 is a block diagram of the image forming apparatus according to the present disclosure.

FIG. 2 is a cross-sectional view of an image forming apparatus 1 according to the present disclosure. FIG. 3 is a block diagram of the image forming apparatus 1 according to the present disclosure.

The image forming apparatus 1 in the present embodiment is a cartridge-type laser beam printer using an electrophotographic process. Specifically, the image forming apparatus 1 is connected to a host apparatus 200, such as a personal computer or an image reader, via a LAN to perform an image forming operation on a recording material Q in the form of a sheet on the basis of electric image information input from the host apparatus 200 to a control portion 101. The control portion 101 transmits/receives various electric information between the host apparatus 200 and a display portion 102 and also performs integrated control over the image forming operation by an apparatus main body 10 in accordance with a predetermined control program or a reference table.

A cartridge CR in the present embodiment is an integrated cartridge in which a photosensitive drum 20 as a rotatable image bearing member, a charging roller 21 as a charging member, a cleaning blade 22, a developing sleeve 30 as a developer bearing member, and a magnet roller 31 are embedded. The charging roller 21, the cleaning blade 22, the developing sleeve 30, and the magnet roller 31 each mentioned herein form electrophotographic process means which acts on the photosensitive drum 20. The cartridge CR is allowed be attached to and detached from the apparatus main body 10 by opening a main body door 105 as indicated by the one-dot-dash line relative to the apparatus main body 10 and thus greatly opening the inside of the apparatus main body 10.

When the cartridge CR is sufficiently inserted, the cartridge CR is held at a predetermined fixing position so that the photosensitive drum 20 is set at a position where the photosensitive drum 20 is allowed to be irradiated with a laser L from an exposing device 100. In addition, the lower surface of the photosensitive drum 20 is set to face a transfer roller 4. Then, the cartridge CR is confined to the apparatus main body 10 by the main body door 105.

In the apparatus main body 10, a door switch 107 (safety switch or kill switch) is disposed. The door switch 107 is turned OFF when the main body door 105 is opened, while being turned ON when the main body door 105 is closed.

By fixing the cartridge CR to a predetermined position in the apparatus main body 10 and closing the main body door 105, the cartridge CR is mechanically and electrically coupled to the apparatus main body 10. In other words, the driven members (such as the photosensitive drum 20 and the developing sleeve 30) in the cartridge CR are allowed to be driven by a driving mechanism (not illustrated) in the apparatus main body 10. In addition, charging voltage applying means 120 and developing voltage applying means 130 each as a bias applying power source portion in the apparatus main body 10 are allowed to apply predetermined biases to the charging roller 21 and the developing sleeve 30 in the cartridge CR.

In the state where a main power source switch 106 is turned ON (power source is turned ON), the cartridge CR is fixed, and the door switch 107 is turned ON by closing the main body door 105, the apparatus main body 10 is in a standby state where the image forming operation is possible.

In the standby state, when electric image information to be printed is input from the host apparatus 200 to the control portion 101, the control portion 101 processes the input image information using an image processing portion (not illustrated). Then, the control portion 101 performs an image forming process on the basis of an image formation start signal (print start signal). Specifically, a drive motor (not illustrated) is activated so that the photosensitive drum 20 is driven to rotate at a predetermined moving speed (process speed Vp).

In the present embodiment, the photosensitive drum 20 is an electrophotographic photosensitive member in the form of a rotating drum. As the photosensitive drum 20, a stacked type is used in which an underlying layer, an intermediate layer, a carrier generating layer, and a carrier transport layer are formed over a conductive cylinder.

The photosensitive drum 20 driven to rotate at the predetermined speed has a surface thereof uniformly charged by the charging roller 21 to have a predetermined polarity and a predetermined potential. To the charging roller 21, a predetermined charging bias voltage (charging voltage) is applied using the charging voltage applying means 120. As the charging voltage, a high voltage obtained by superimposing an AC voltage (alternating-current voltage) on a DC voltage (direct-current voltage) is used. In other words, to the charging roller 21, an alternating-current voltage having at least a predetermined frequency (charging frequency) is applied as the charging voltage.

When the exposing device 100 performs laser scanning exposure on the surface of the photosensitive drum 20 processed by charging, the laser beam L is incident on the photosensitive drum 20 to form an electrostatic latent image at a predetermined resolution on the surface of the photosensitive drum 20. The electrostatic latent image thus formed is borne and conveyed by the photosensitive drum 20 rotating at the predetermined moving speed. The electrostatic latent image is developed as a toner image on the developing sleeve 30 with a toner T as a developer. In the present embodiment, the electrostatic latent image is formed by image exposure which performs intensive exposure on an image portion on which the toner T is to be deposited and background exposure which performs weak exposure on a non-image portion. The electrostatic latent image is reversal-developed using a jumping developing method using a negative charging magnetic mono-component toner (negative toner).

The developing sleeve 30 is disposed to face the photosensitive drum 20 with a predetermined distance provided therebetween and driven to rotate at a predetermined speed. The magnet roller 31 is disposed to be fixed, while being enclosed in the developing sleeve 30. A developing blade 32 is an elastic member and disposed to come into contact with the developing sleeve 30, while being warped against the elasticity of the developing sleeve 30. A stirring member 33 rotates at a predetermined speed in association with the rotation of the developing sleeve 30 to stir the toner T in a developing vessel 34 and also supply the toner T to the developing sleeve 30.

The toner T is magnetically adsorbed to the developing sleeve 30 by the magnetic force of the magnet roller 31 to be borne thereon. The tonner T is evened out into a layer having a predetermined thickness and conveyed by the developing blade 32 to a developing zone facing the photosensitive drum 20. Thus, the toner T as the developer is borne and conveyed by the developing sleeve 30 as the developer bearing member.

To the developing sleeve 30, a predetermined developing bias (developing voltage) is applied by the developing voltage applying means 130 provided in the apparatus main body 10 to allow the developing sleeve 30 to develop the electrostatic latent image. As the developing voltage, a voltage obtained by superimposing an AC voltage (alternating-current voltage) on a DC voltage (direct-current voltage) is used. Specifically, to the developing sleeve 30, an AC voltage (alternating-current voltage) having at least a predetermined frequency (developing frequency) is applied as the developing voltage.

On the other hand, the control portion 101 drives a feeding roller 61 to rotate with a predetermined control timing. Consequently, the recording materials Q as recording materials contained in stacked relation in a paper feed cassette 6 are fed. From the recording materials Q, one is separated by a separating roller 62 and introduced into a transfer nip portion as a contact region between the photosensitive drum 20 and the transfer roller 4.

In the process in which the recording material is conveyed through the transfer nip portion, while being held thereby, a transfer voltage at a predetermined potential is applied to the transfer roller 4 to allow the tonner image on the surface of the photosensitive drum 20 to be sequentially electrostatically transferred onto the surface of the recording material. The recording material Q through the transfer nip portion is separated from the surface of the photosensitive drum 20 and introduced into a fixing device 5 through a conveying device so that the tonner image is fixed as a fixed image onto the surface of the recording material. A paper discharge roller pair 104 discharges the recording material out of the apparatus.

On the other hand, from the surface of the photosensitive drum 20 after the recording material is separated therefrom, a residual deposit such as the untransferred toner is removed by the cleaning blade 22. Thus, the surface of the photosensitive drum 20 is cleaned and repeatedly used for image formation.

A description will be given herein of a moire image which is formed depending on the relationship between a frequency (charging frequency) fp of the charging voltage for charging the photosensitive drum 20 and an image frequency F.

To charge the photosensitive drum 20, a high-voltage output obtained by superimposing a high AC voltage on a high DC voltage is used as the charging voltage. In this case, the charging DC voltage has about the same value as that of a primary charging potential V0 as a post-charging potential at the photosensitive drum 20. The charging AC voltage has an excellent charging uniformity and is therefore used to allow efficient charging to be performed.

The frequency fp (Hz) of the charging voltage is set to an appropriate value so as to allow the photosensitive drum 20 to be uniformly charged, while inhibiting a charging sound from being generated in a charging step.

The charging potential formed over the photosensitive drum is affected by the AC voltage in the charging voltage, and a small potential difference having the same period as that of the frequency fp (Hz) is produced.

The electrophotographic laser printer forms an electrostatic latent image on the photosensitive drum 20 by laser scanning exposure. As a result of the laser scanning exposure, the electrostatic latent image formed at a predetermined resolution D is developed with a developer to become a visible image.

In an image exposure step using a laser, when a pattern in which N dots are exposed and n dots are not exposed (space) is periodically formed in the direction of rotation of the photosensitive drum 20, an electrostatic latent image is formed at (N+n)-dot periods. When (N+n) dots are collectively represented in dots for dot periods, the (N+n)-dot periods may be referred to also as n-dot periods (where n is an integer of not less than 2).

An image at the (N+n)-dot periods is calculated as the image frequency F (Hz) on the basis of the following expression using the resolution D (dpi) at which laser scanning exposure is performed and the rotation speed Vp (mm/sec) of the photosensitive drum 20.

$$F = \frac{D \times Vp}{(N+n) \times 25.4} \text{[Hz]}$$

For example, in the direction of rotation of the photosensitive drum 20, a 3-dot-period image obtained by periodically forming such a pattern in which 1 dot is exposed and 2 dots are not exposed (space) is given by F=600 (dots/inch)×Vp (mm/sec)/(3 dots×25.4 (mm/inch)) (Hz).

As a result of the interference between the image frequency F (Hz) obtained from the foregoing expression and the frequency (equal to the charging frequency fp) (Hz) of the small potential difference formed over the photosensitive drum 20 in the charging step, the potential of the electrostatic latent image over the image bearing member may become non-uniform to result in the formation of a more image. At this time, a moire pitch P is given by the following expression.

$$P = \frac{Vp}{|F - fp|} \text{[mm]}$$

The way the moire image looks varies in accordance with the calculated value of the moire pitch P. In general, the moire pitch that is recognizable by a user is in the range of 0.7<P<10 (mm) In the range of P<0.7, the pitch is sufficiently high so that the user rarely recognizes the moire image. On the other hand, in the range of P>10 (mm), the period is sufficiently long so that the moire image is indistinctive.

In the range of P<10 (mm), the unevenness of the moire image is larger as the moire pitch P is higher. It is assumed that the largest moire pitch value P in the range of P<10 (mm) is a maximum moire pitch value Pmax. It is assumed herein that a threshold (X) is 10 (mm) and the largest moire pitch value P in the range smaller than the threshold is the maximum moire pitch value Pmax. The threshold X (mm) is settable in the range of X≥10 (mm).

In the present embodiment, a laser power E1, which is a background exposure amount described below, is set appropriately in accordance with the maximum moire pitch value Pmax to thus inhibit optical degradation of the photosensitive drum, while inhibiting a moire image. Specifically, as the maximum moire pitch value Pmax is larger, the laser power E1 is set higher in a range as small as needed.

First, a description will be given of the background exposure.

Figure 4:
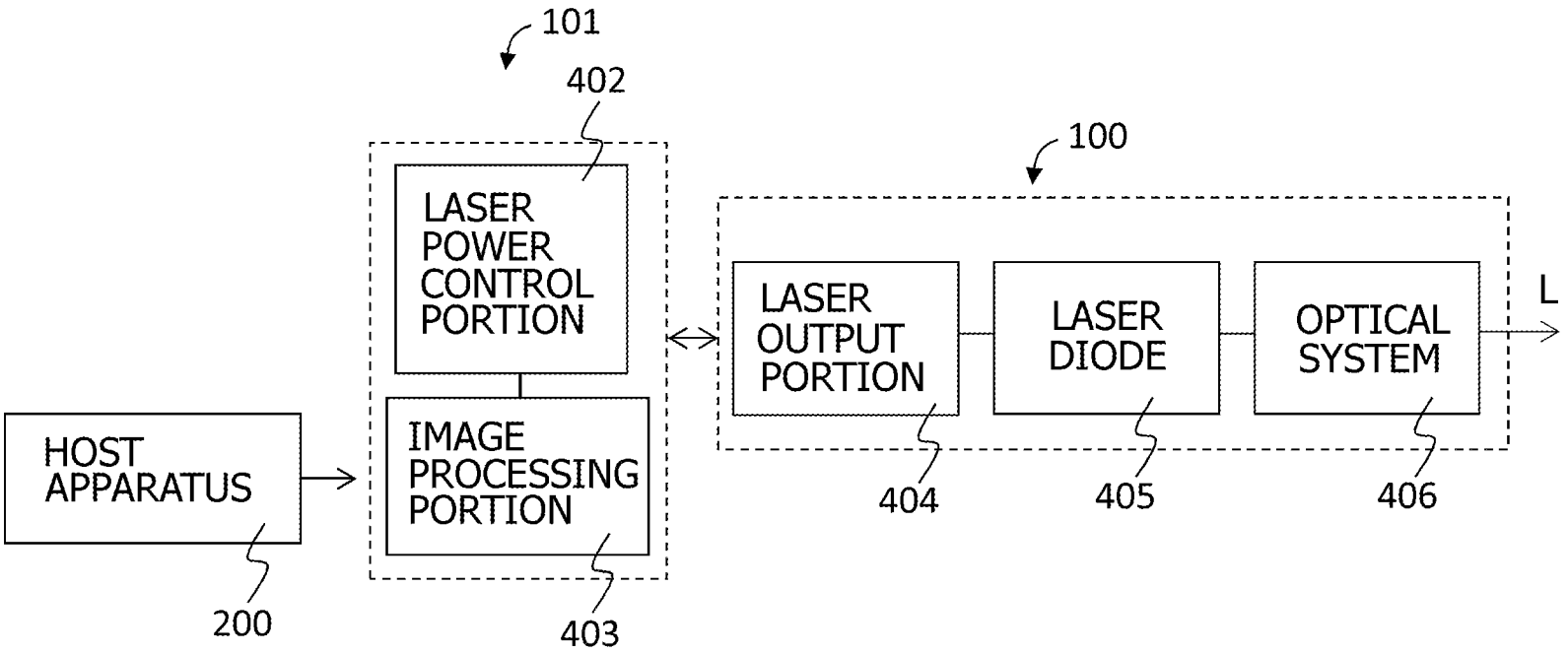
FIG. 4 is a block diagram of an exposing device according to the present disclosure.

Using FIG. 4, a description will be given of the exposing device (laser exposing unit) 100 in the present embodiment. FIG. 4 illustrates a block diagram associated with a laser power control system. The exposing device 100 in the present embodiment is configured to be able to switchably output either of the 2-level output values of the first laser power (E1) and a second laser power (E2) as a laser output when the surface of the photosensitive drum 20 is exposed. Specifically, in the control portion 101, a laser power control portion 402 which individually controls each of the laser powers and an image processing portion 403 are provided. An image signal transmitted from the host apparatus 200 is a multi-value signal. The control portion 101 controls the laser power to multiple levels, while the exposing device 100 emits the laser L.

In the present embodiment, the laser power control portion 402 individually controls the first laser power (E1) and the second laser power (E2) for each of the print modes. The first laser power (E1) is a laser power (background exposure amount) for forming a dark portion potential Vd (non-image portion potential) for a non-image portion (background portion) as a white background portion. The non-image portion (background portion) as the white background portion is the region of the surface of the photosensitive drum 20 where no image is formed. The second laser power (E2) is a laser power for forming a bright portion potential (image portion potential V1) for an image portion (black letter portion). The image portion (black letter portion) is the region of the surface of the photosensitive drum 20 where an image is formed. The first laser power (E1) is lower than the second laser power (E2). In the present embodiment, in an image forming step, a predetermined bias current is allowed to flow in a laser diode 405 to cause weak laser emission, and the emitted laser is set as the first laser power (E1). The laser power control portion 402 is configured to apply a current value to the image portion and allow a current to flow therein, thus providing the second laser power (E2). It is assumed that the laser power control portion 402 controls (adjusts) the laser powers E1 and E2 by varying an amount of current allowed to flow in the laser diode 405. A laser output portion 404 switches between the laser powers in accordance with the signal input thereto from the laser power control portion 402 to cause the laser diode 405 to emit light. The emitted light passes through a correcting optical system 406 including a polygon mirror to serve as the laser scanning beam L which irradiates the photosensitive drum 20.

Using FIGS. 5A and 5B, a description will be given of the setting of a latent image in the present embodiment.

Figure 5A:
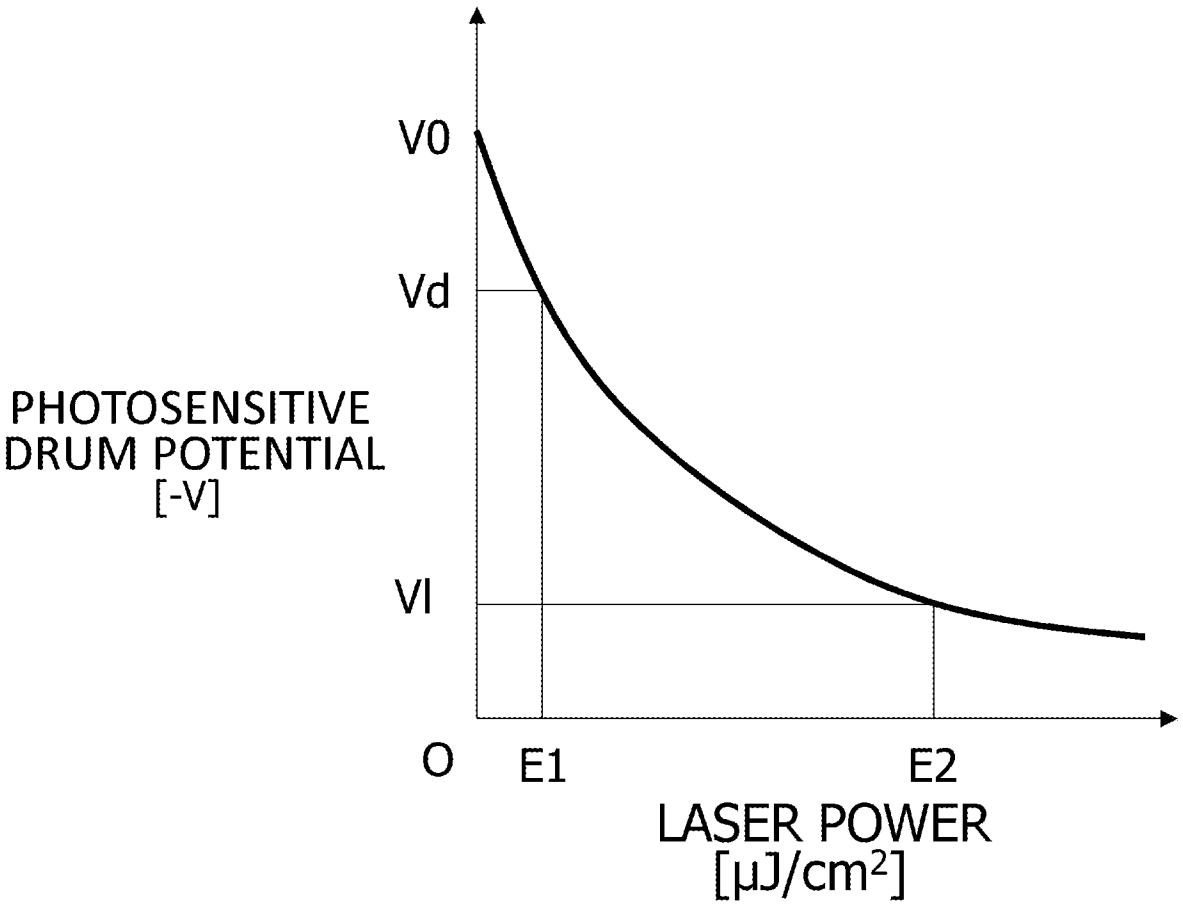
FIGS. 5A and 5B are views illustrating the settings of a latent image according to the present disclosure.

FIG. 5A is a view illustrating the relationship (hereinafter referred to as the E-V curve) between the surface potential of the photosensitive drum 20 and an exposing laser power. What is illustrated herein is the relationship between the surface potential and the exposing laser power when a DC voltage V0=−650 [V] and an AC voltage which is a sine wave having a peak-to-peak voltage Vpp=1.6 [kV] and a charging frequency fp=1680 Hz are applied as the charging voltage to the charging roller 21. The abscissa axis of the graph represents a laser power E ($\mu J/cm^2$) received by the surface of the photosensitive drum 20. The exposing device 100 exposes the image portion of the photosensitive drum 20 to the second laser power E2=0.35 ($\mu J/cm^2$) to form the bright portion potential (V1) of about −100 (V). At the same time, the exposing device 100 also exposes the non-image portion (background) to the first laser power E1 ($\mu J/cm^2$) to form the dark portion potential (Vd) of about −500 (V). To the developing sleeve 30, a high voltage obtained by superimposing the AC voltage on the DC voltage is applied as a developing bias voltage (developing voltage). As the DC voltage, a voltage Vdc=−350 (V) is applied while, as the AC voltage, a rectangular wave having the developing frequency fd=2500 (Hz), the peak-to-peak voltage Vpp=1600 (V), and a duty ratio Duty=50% is applied. Consequently, the negatively charged toner T conveyed to a developing position is deposited on the portion at the bright portion potential (V1) due to a potential contrast between the bright portion potential (V1) and the developing bias voltage Vdc over the photosensitive drum 20 so that an electrostatic latent image is reversal-developed as a toner image.

Note that, in the present embodiment, a reversal developing method is used. Accordingly, the region exposed to the second laser power E2 ($\mu J/cm^2$) corresponds to the image portion, while the region exposed to the first laser power E1 ($\mu J/cm^2$) corresponds to the non-image portion (background portion) as the white background portion.

Figure 5B:
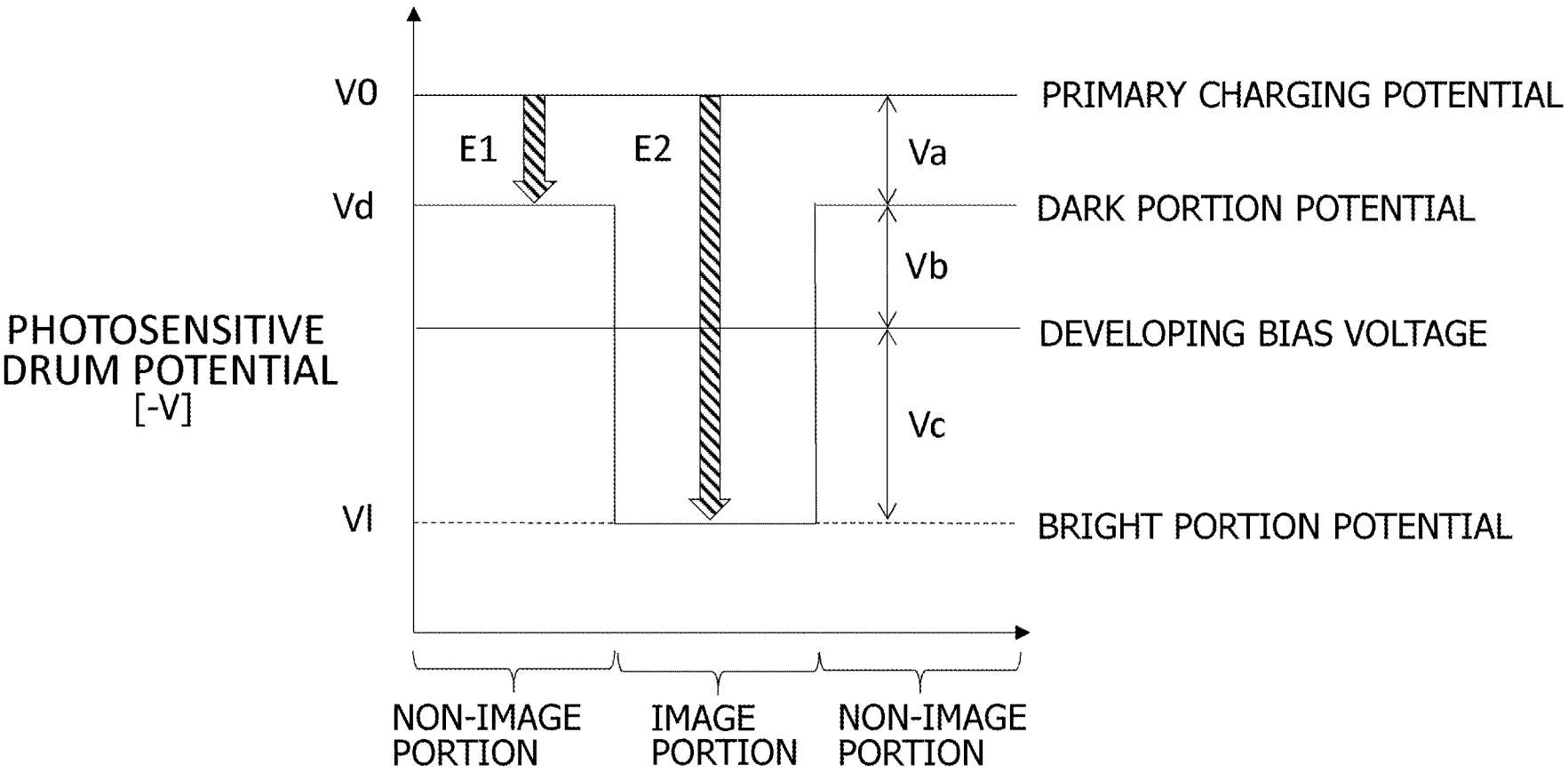

FIG. 5B is a view illustrating the setting of the potentials. The developing contrast (Vc) as the difference between the bright portion potential (V1) and the developing bias voltage (Vdc) serves as a factor in setting the image density and gradation of the image portion. Specifically, when the developing contrast (Vc) decreases, a sufficient image density and sufficient gradation are unobtainable. Accordingly, it is needed to ensure the developing contrast (Vc) having a predetermined value or more. In the present embodiment, the developing contrast is set to Vc=250 (V). On the other hand, a white background portion contrast (Vb) as the difference between the developing bias voltage (Vdc) and the dark portion potential (Vd) serves as a factor in determining an amount of fogging (background contamination) in the white background portion. Specifically, when the white background portion contrast (Vb) increases to be above a predetermined value, the oppositely charged toner (i.e., positively charged toner) is deposited on the white background portion to result in fogging, which causes image contamination, in-apparatus contamination, or the like. On the other hand, when the white background portion contrast (Vb) decreases to be below the predetermined value, the normally charged toner (i.e., negatively charge toner) is developed on the white background portion to result in fogging. Accordingly, the white background portion contrast (Vb) needs to be set within a predetermined range. In the present embodiment, the white background portion contrast is set to Vb=150 (V).

The primary charging potential V0 is the potential applied to the charging roller 21 after charging and before exposure, which is the voltage substantially equal to the DC voltage in the charging voltage. The difference between the primary charging potential V0 and the dark portion potential Vd, i.e., the difference between a pre-exposure photosensitive drum potential and a post-exposure photosensitive drum potential obtained by changing the pre-exposure photosensitive drum potential by exposure to the first laser power E1 is defined as a background potential difference Va.

When the background potential difference Va is set large, slight fluctuations in the charging potential of the charging frequency fp (Hz) formed over the photosensitive drum 20 are smoothed by the exposure to the first laser power E1 to form the potential Vd. By such smoothing of the dark portion potential Vd in the non-image portion, the interference with the image frequency is reduced so that a moire image is inhibited.

The first laser power E1 needs to be able to inhibit a moire image and also needs to be set to a lowest laser power. The first laser power E1 is related to the optical degradation of the photosensitive drum 20. When the photosensitive drum 20 is used for a long period while the first laser power E1 is set high, it may be possible that the photosensitive drum 20 is optically degraded and the sensitivity property thereof with respect to laser beam is significantly reduced.

Referring to FIG. 1, a description will be given of image forming modes and the first laser power in the image forming apparatus in the present embodiment in conjunction with those in comparative examples. FIG. 1 is a table of the various modes in the image forming apparatus in the present embodiment. The image forming apparatus in the present embodiment includes a mode A as a standard mode, a mode B as a high-image-quality mode, and a mode C as a highest-image-quality mode. The process speed is Vp=165 (mm/sec) in each of the modes A, B, and C. The image resolution D is 600 (dpi) in the mode A, 900 (dpi) in the mode B, and 1200 (dpi) in the mode C. The plurality of image forming modes that are settable in the image forming apparatus in the present embodiment may appropriately be modes which are different in at least any of the resolution, the process speed, and the charging frequency and are not limited to the modes described below.

In the present first embodiment, the charging frequency is set to 1680 (Hz) in each of the modes A, B, and C. In the charging roller 21 used in the present embodiment, by setting the charging frequency to a value of less than 2500 (Hz), it is possible to inhibit a charging sound. Conversely, when the charging frequency is set to a value of not less than 2500 (Hz), an annoying high-note charging sound is generated.

In the mode A in the first embodiment, the moire pitch in an image at, e.g., 2-dot periods is P=0.61 (mm), while the moire pitch P in an image at 3-dot periods is 0.43 (mm). Thus, a moire pitch value at each of dot periods, i.e., (N+n)-dot periods (where each of N and n is a natural number) is calculated. The highest moire pitch when P<10 (mm) is satisfied in the mode A in the first embodiment is obtained at the 2-dot periods so that the maximum moire pitch value is Pmax=0.61 (mm) The largest moire pitch value P at the (N+n)-dot periods (where each of N and n is a natural number) when P<10 (mm) is satisfied is the maximum moire pitch value Pmax (mm).

When Pmax<0.7 is satisfied, the moire pitch is sufficiently low so that, even without the background exposure, no moire image is generated. Accordingly, the background potential difference is set to Va=0 (V), the first laser power is set to E1=0 (μJ/cm$^2$), and no background exposure is performed. The DC voltage V0 in the charging voltage is set to −500 (V), similarly to the non-image portion potential Vd.

In the mode B in the first embodiment, the image resolution is D=900 (dpi), and the image frequency F is different from that in the mode A. The maximum moire pitch value Pmax when P<10 (mm) is satisfied is 0.76 (mm) at 4-dot periods. Since P>0.7 is satisfied, to inhibit a moire image, the background exposure is performed. By performing the background exposure, the dark portion potential Vd over the photosensitive drum is smoothed. In the present embodiment, the smallest background potential difference needed to inhibit a moire image where the maximum moire pitch value was Pmax=0.76 (mm) was Va=75 (V) and, at this time, the first laser beam amount E1 was 0.05 (μJ/cm$^2$). Accordingly, the first laser power is set to E1=0.05 (μJ/cm$^2$). Also, to provide the non-image portion potential Vd=−500 (V) which is equal to that in the mode A, the DC voltage in the charging voltage is set to V0=−575 (V). When the non-image portion potential Vd is set equal to that in the mode A, an image having an image density equal to that in the mode A is obtained. Thus, in the mode B, the maximum moire pitch value Pmax is larger than that in the mode A so that the background potential difference Va is set larger than in the mode A. Consequently, in the mode B, the first laser power E1 as the exposure amount at which the background portion is exposed is set higher than in the mode A, and the absolute value of the primary charging potential V0 as the DC voltage output from the charging voltage applying means is set larger than in the mode A. Conversely, in the mode A, the maximum moire pitch value Pmax is smaller than in the mode B so that the background potential difference Va is set smaller than in the mode B. Consequently, in the mode A, the first laser power E1 as the dose at which the background portion is exposed is set lower than in the mode B, and the absolute value of the primary charging potential V0 as the DC voltage output from the charging voltage applying means is set smaller than in the mode B.

In the mode C in the first embodiment, the image resolution is D=1200 (dpi), and the image frequency F is different from those in the modes A and B. The maximum moire pitch value Pmax when P<10 (mm) is satisfied is 1.36 (mm) at 5-dot periods. Since P>0.7 is satisfied and the maximum moire pitch value Pmax is larger than in the mode B, to inhibit a moire image, the background exposure is performed using the first laser power E1 higher than in the mode B. In the present embodiment, the smallest background potential difference needed to inhibit a moire image where the maximum moire pitch value was Pmax=1.36 (mm) was Va=150 (V) and, at this time, the first laser power E1 was 0.10 (μJ/cm$^2$). Accordingly, the first laser power is set to E1=0.10 (μJ/cm$^2$). Also, to provide the non-image portion potential Vd=−500 (V) which is equal to that in the mode A, the DC voltage in the charging voltage is set to V0=−650 (V). Thus, in the mode C, the maximum moire pitch value Pmax is larger than in the mode B so that the background potential difference Va is set larger than in the mode B. Consequently, in the mode C, the first laser power E1 as the dose at which the background portion is exposed is set higher than in the mode B, and the absolute value of the primary charging potential V0 as the DC voltage output from the charging voltage applying means is set larger than in the mode B. Conversely, in the mode B, the maximum moire pitch value Pmax is smaller than in the mode C so that the background potential difference Va is set smaller than in the mode C. Consequently, in the mode B, the first laser power E1 as the dose at which the background portion is exposed is set lower than in the mode C, and the absolute value of the primary charging potential V0 as the DC voltage output from the charging voltage applying means is set smaller than in the mode C.

Note that the same settings are made with regard also to the modes A and C, though a detailed description thereof is omitted.

A comparative example b is a comparative example in which, in the modes B and C, the background exposure is not performed. In the mode Bin the comparative example b, the moire pitch at 4-dot periods is P>0.70 and the background exposure is not performed. Consequently, slight potential fluctuations in the charging voltage formed over the photosensitive drum interfered with a 4-dot image frequency so that a moire image was generated in a 4-dot-period image. In the mode C in the comparative example b, a moire image was similarly generated in a 5-dot-period image.

A comparative example c is a comparative example in which, in each of the modes B and C, the charging frequency fp is set high in accordance with the image frequency F. When the charging frequency fp is thus changed in accordance with a change in the image frequency F, it is possible to set the maximum image pitch value to Pmax<0.7 (mm) and inhibit a moire image even without the background exposure. However, since the charging frequency was not lower than 2500 (Hz) in each of the modes B and C, an annoying high-note charging sound was generated during image formation.

A comparative example d is a comparative example in which, in each of the modes A, B, and C, the background exposure was performed using the given first laser power E1=0.10 (μJ/cm$^2$). The comparative example d had a problem to be solved in the optical fatigue of the photosensitive drum when used for a long period of time.

Figure 6:
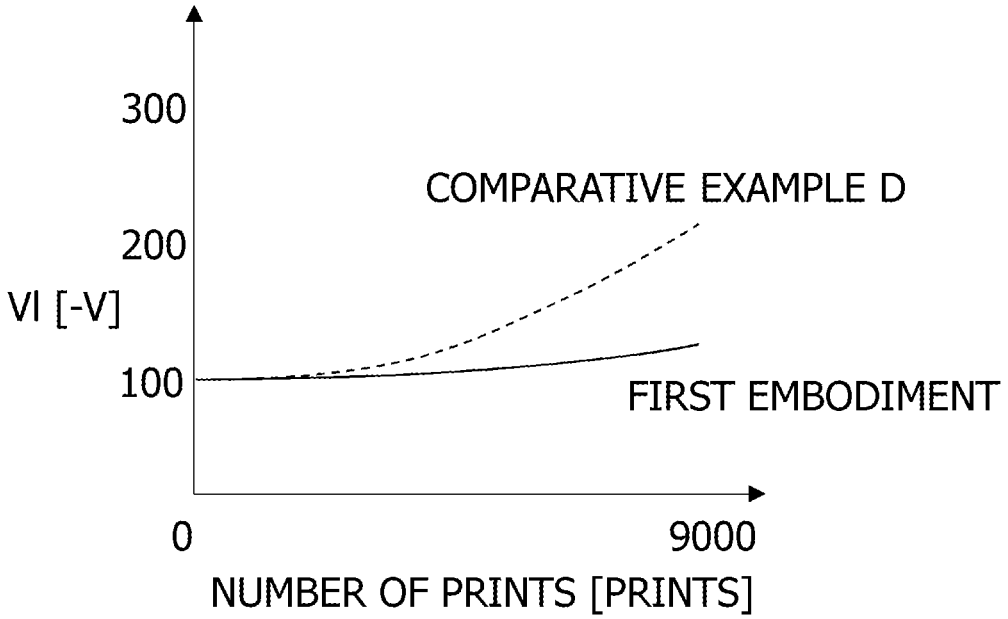
FIG. 6 is a view illustrating the result of an experiment on the optical fatigue of a photosensitive drum according to the first embodiment of the present disclosure.

Using FIG. 6, a description will be given herein of the optical fatigue of the photosensitive drum when used for a long period of time. FIG. 6 is a graph of the bright portion potential V1 when an image was repeatedly printed on the total of 9000 sheets including the 3000 sheets on which the image was printed in the mode A, the 3000 sheets on which the image was printed in the mode B, and the 3000 sheets on which the image was printed in the mode C. The print percentage of the image was set to 4%. In the drawing, the solid line indicates the result in the first embodiment, while the broken line indicates the result in the comparative example d as a target for comparison.

In the comparative example d, the drum bright portion potential V1 in the initial period of use was −100 (V) but, after consecutive printing on the 9000 sheets, the drum bright portion potential V1 significantly changed to −210 (V). In addition, since V1=−210 (V) was satisfied, the contrast potential Vc lowered, and the image density lowered. By contrast, in the first embodiment, the drum bright portion potential V1 in the initial period of use was −100 (V), and the drum bright portion potential V1 after repeated printing on the 9000 sheets was −120 (V). Thus, even after the repeated printing was performed, the drum sensitivity change was small. Since a reduction in the contrast potential Vc was also small, the image density equal to that in the initial period of use was retained.

In the comparative example d, the drum bright portion potential V1 significantly changed due to the optical degradation of the photosensitive drum. The optical degradation of the photosensitive drum is a phenomenon in which, as a result of irradiating the photosensitive drum with a laser having a higher laser power for a long period of time, charges gradually remain to degrade the sensitivity of the photosensitive drum. From this result, it is to be understood that, when the first laser power E1 as the background exposure dose is set as low as possible, it is possible to reliably inhibit the optical degradation of the photosensitive drum.

When a user using the plurality of modes has thus used the image forming apparatus for a long period, by setting the background exposure dose to a smallest needed value in each of the modes, it is possible to output a stable image for a longer period of time, while inhibiting a moire image.

As described above, in the present embodiment, the first laser power E1 as the background exposure dose is set to a smallest needed value in accordance with the maximum moire pitch value Pmax determined by the relationship between the image frequency and the charging frequency. By thus setting the first laser power E1, it is possible to reduce the optical degradation of the photosensitive drum to minimum, while inhibiting a moire image.

Consequently, it is possible to provide an image forming apparatus capable of more reliably inhibiting the optical fatigue of the photosensitive drum and outputting a stable image for a long period, while inhibiting the interference between the image frequency and the charging frequency and inhibiting a moire image.

Second Embodiment

A description will be given of a second embodiment of the present disclosure. The same components as in the first embodiment are given the same reference numerals and a detailed description thereof is omitted.

Referring to FIG. 7, a description will be given of image forming modes and a first laser power in an image forming apparatus in the present embodiment in conjunction with those in comparative examples. FIG. 7 is a table of various modes in the image forming apparatus in the present embodiment. The image forming apparatus in the present embodiment includes the mode A as a standard mode, a mode G as a high-speed mode, and a mode H as a highest-speed mode. The process speed in the mode A is Vp=165 (mm/sec). A process speed in the mode G is Vp=248 (mm/sec). A process speed in the mode H is Vp=330 (mm/sec). The image resolution D is 600 (dpi) in the mode A, 400 (dpi) in the mode G, and 300 (dpi) in the mode H. In other words, the image forming apparatus in the present disclosure has specifications such that the image frequency F differs from one mode to another in each of the process speed Vp and the image resolution D.

In the present second embodiment, the charging frequency is set to 1680 (Hz) in each of the modes A, G, and H. The charging frequency is the frequency at which a charging sound is ignorable.

The highest moire pitch when P<10 (mm) is satisfied in the mode A in the second embodiment is obtained at 2-dot periods so that the maximum moire pitch value is Pmax=0.61 (mm).

When Pmax<0.7 is satisfied, the moire pitch is sufficiently low so that a moire image is not generated even without background exposure. Accordingly, the background potential difference is set to Va=0 (V), the first laser power is set to E1=0 (μJ/cm$^2$), and no background exposure is performed. The DC voltage V0 in the charging voltage is set to −500 (V), similarly to the non-image portion potential Vd.

In the mode G in the second embodiment, the image resolution and the process speed Vp are different from those in the mode A so that the image frequency F is different from that in the mode A. The maximum moire pitch value Pmax when P<10 (mm) is satisfied is 0.91 (mm) at 2-dot periods. Since P>0.7 is satisfied, to inhibit a moire image, the background exposure is performed. By performing the background exposure, the dark portion potential Vd over the photosensitive drum is smoothed. In the present embodiment, the smallest background potential difference needed to inhibit a moire image where the maximum moire pitch value was Pmax=0.91 (mm) was Va=100 (V) and, at this time, the first laser beam amount E1 was 0.7 (μJ/cm$^2$). Accordingly, the first laser beam amount is set to E1=0.07 (μJ/cm$^2$). Also, to provide the non-image portion potential Vd=−500 (V) which is equal to that in the mode A, the DC voltage in the charging voltage is set to V0=−600 (V). When the non-image portion potential Vd is set equal to that in the mode A, an image having an image density and fogging which are equal to those in the mode A is obtained. Thus, in the mode G, the maximum moire pitch value Pmax is larger than in the mode A so that the background potential difference Va is set larger than in the mode A. Consequently, in the mode G, the first laser beam amount E1 as the dose at which the background portion is exposed is set larger than in the mode A, and the absolute value of the primary charging potential V0 as the DC voltage output from the charging voltage applying means is set larger than in the mode A. Conversely, in the mode A, the maximum moire pitch value Pmax is smaller than in the mode G so that the background potential difference Va is set smaller than in the mode G. Consequently, in the mode A, the first laser beam amount E1 as the dose at which the background portion is exposed is set smaller than in the mode B, and the absolute value of the primary charging potential V0 as the DC voltage output from the charging voltage applying means is set smaller than in the mode B.

In the mode H in the second embodiment, the image resolution and the process speed Vp are different from those in each of the modes A and G so that the image frequency F is different from those in the modes A and G. The maximum moire pitch value Pmax when P<10 (mm) is satisfied is 1.23 (mm) at the 2-dot periods. Since P>0.7 is satisfied and the maximum moire pitch value Pmax is larger than that in the mode G, the background exposure is performed using the first laser power E1 higher than that in the mode G. In the present embodiment, the smallest background potential difference needed to inhibit a moire image where the maximum moire pitch value was Pmax=1.23 (mm) was Va=150 (V) and, at this time, the first laser power E1 was 0.10 (μJ/cm$^2$). Accordingly, the first laser power is set to E1=0.10 (μJ/cm$^2$). Also, to provide the non-image portion potential Vd=−500 (V) which is equal to that in the mode A, the DC voltage in the charging voltage is set to V0=−650 (V). Thus, in the mode H, the maximum moire pitch value Pmax is larger than in the mode G so that the background potential difference Va is set larger than in the mode G. Consequently, in the mode H, the first laser power E1 as the dose at which the background portion is exposed is set larger than in the mode G, and the absolute value of the primary charging potential V0 as the DC voltage output from the charging voltage applying means is set larger than in the mode G. Conversely, in the mode G, the maximum moire pitch value Pmax is smaller than in the mode H so that the background potential difference Va is set smaller than in the mode H. Consequently, in the mode G, the first laser power E1 as the dose at which the background portion is exposed is set smaller than in the mode H, and the absolute value of the primary charging potential V0 as the DC voltage output from the charging voltage applying means is set smaller than in the mode H.

Note that the same settings are made with regard also to the modes A and H, though the details thereof are omitted.

A comparative example g is a comparative example in which, in the modes G and H, the background exposure is not performed. In the mode G in the comparative example g, the moire pitch at the 2-dot periods is P>0.70 and the background exposure is not performed. Consequently, slight potential fluctuations in the charging voltage formed over the photosensitive drum interfered with a 2-dot image frequency so that a moire image was generated in a 2-dot-period image. In the mode H in the comparative example g also, a moire image was similarly generated in a 2-dot-period image.

A comparative example h is a comparative example in which, in the modes G and H, the charging frequency fp is set high in accordance with the image frequency F. When the charging frequency fp is changed in accordance with a change in the image frequency F, it is possible to set the maximum moire pitch value to Pmax<0.7 (mm) and inhibit a moire image even without the background exposure. However, since the charging frequency was not lower than 2500 (Hz) in each of the modes G and H, an annoying high-tone charging sound was generated during image formation.

A comparative example j is a comparative example in which, in each of the modes A, G, and H, the background exposure was performed using the given first laser power E1=0.10 ($\mu J/cm^2$). The comparative example j had a problem to be solved in the optical fatigue of the photosensitive drum when used for a long period of time.

An experiment was performed in which an image was repeatedly printed on the total of 9000 sheets including the 3000 sheets on which the image was printed in the mode A, the 3000 sheets on which the image was printed in the mode G, and the 3000 sheets on which the image was printed in the mode H, and changes in the bright portion potential V1 of the photosensitive drum and the images were checked. In each of the comparative examples in the first embodiment, the drum bright portion potential V1 in the initial period of use was −100 (V) but, after the repeated printing on the 9000 sheets, the drum bright portion potential V1 significantly changed to −210 (V). In addition, since the drum bright portion potential was V1=−210 (V), the contrast potential Vc lowered, and the image density lowered. By contrast, in the second embodiment, as a result of performing the same experiment, the drum bright portion potential V1 in the initial period of use was −100 (V), while the drum bright portion potential V1 after repeated printing on the 9000 sheets was −125 (V). Thus, even after the repeated printing was performed also, the drum sensitivity change was small. Since a reduction in the contrast potential Vc was also small, the image density equal to that in the initial period of use was retained.

When a user using the plurality of modes has thus used the image forming apparatus for a long period, by setting the background exposure dose to a smallest needed value in each of the modes, it is possible to output a stable image for a longer period of time, while inhibiting a moire image.

As described above, in the present embodiment, the first laser power E1 as the background exposure dose is set to a smallest needed value in accordance with the maximum moire pitch value Pmax determined by the relationship between the image frequency and the charging frequency. By thus setting the first laser power E1, it is possible to reduce the optical degradation of the photosensitive drum to minimum, while inhibiting a moire image.

Consequently, it is possible to provide an image forming apparatus capable of more reliably inhibiting the optical fatigue of the photosensitive drum and outputting a stable image for a long period, while inhibiting the interference between the image frequency and the charging frequency and inhibiting a moire image.

Third Embodiment

A description will be given of a third embodiment of the present disclosure. The same components as in the first embodiment are given the same reference numerals and a detailed description thereof is omitted.

A description will be given of a moire resulting from the interference between the charging frequency fp and the developing frequency fd.

In the same manner as in the first embodiment, the photosensitive drum is charged using an AC charging method. The charging potential formed over the photosensitive drum is affected by the AC voltage in the charging voltage, and a small potential difference having the same period as that of the frequency fp (Hz) is generated.

As the developing voltage also, in the same manner as in the first embodiment, a developing voltage obtained by superimposing an AC voltage on a DC voltage is used. Due to the frequency (developing frequency) fd of the developing voltage, a toner is developed on the photosensitive drum, while reciprocating between the photosensitive drum and the developing sleeve. At this time, as a result of the interference between the small potential difference having the same period as that of the frequency fp (Hz) produced over the photosensitive drum and the frequency fd of the developing voltage, a moire image may be generated. This is a moire resulting from the interference between the charging frequency fp and the developing frequency fd. Background exposure is a configuration which is also useful in inhibiting such a moire image resulting from the interference between the charging frequency fp and the developing frequency fd.

A moire image generated by the charging frequency fp and the developing frequency fd may be generated in each of a first order harmonic of one of the charging frequency fp and the developing frequency fd and an m-th order harmonic (m is a natural number) of the other thereof.

At this time, the moire pitch value P in each of the m-th order harmonics is obtainable on the basis of the following expressions.

$$P = \frac{Vp}{|fp - m \times fd|}\,[\text{mm}],$$

where $fp > fd$ $$P = \frac{Vp}{|m \times fp - fd|}\,[\text{mm}],$$

where $fp \leq fd$

The way the moire image looks varies in accordance with the calculated value of the moire pitch. In general, the moire pitch that is recognizable by a user is in the range of 0.7<P<10 (mm). In the range of P<0.7, the pitch is sufficiently high so that the user rarely recognizes the moire image. On the other hand, in the range of P>10 (mm), the period is sufficiently long so that the moire image is indistinctive.

In the range of P<10 (mm), the unevenness of the moire image is larger as the moire pitch P is higher. It is assumed that, when consideration is given to the m-th order harmonic, the largest moire pitch value P in the range of P<10 (mm) is the maximum moire pitch value Pmax. It is assumed herein that a threshold (Y) is 10 (mm) and the largest moire pitch value P in the range smaller than the threshold is the maximum moire pitch value Pmax. The threshold Y (mm) is settable in the range of Y≥10 (mm).

In the present embodiment, the background laser power E1 is set appropriately in accordance with the maximum moire pitch value Pmax to thus inhibit optical degradation of the photosensitive drum, while inhibiting a moire image. Specifically, as the maximum moire pitch value Pmax is larger, the laser power E1 is set higher in a range as small as needed.

Referring to FIG. 8, a description will be given of image forming modes and a first laser power in an image forming apparatus in the present embodiment in conjunction with those in comparative examples. FIG. 8 is a table of various modes in the image forming apparatus in the present embodiment. The image forming apparatus in the present embodiment includes the mode S as a normal environment mode, a mode T as a low-humidity mode, and a mode U as an ultra-low-humidity mode. The modes S, T, U are switched to each other depending on a humidity. The process speed is Vp=185 (mm/sec) in each of the modes S, T, and U. The charging frequency is set to 1450 (Hz) in each of the modes S, T, and U. The charging frequency is the frequency at which a charging sound is ignorable.

A toner as a developer has a charging performance which differs depending on the humidity. In accordance with an amount of charging of the toner, the developing voltage is set as appropriate as possible so as to satisfy an image quality. In the image forming apparatus in the present embodiment, the charging of the toner becomes unstable in a low-humidity environment so that the excessively charged toner or the uncharged toner are increased. In the low-humidity environment, when the same developing voltage is used, a phenomenon referred to as "fogging" in which the toner is developed on the white background portion is worse than in a normal environment. Accordingly, the image forming apparatus in the present embodiment has the modes in which the developing voltage is adjusted depending on the humidity to inhibit the fogging in the low-humidity environment. As a method which inhibits the fogging in the low-temperature environment, a method is known which sets the frequency fd of the developing voltage high. In the mode S as the normal environment mode, the developing frequency is set to fd=2500 (Hz). In the mode T as the low-humidity-mode, the developing frequency is set to fd=2650 (Hz). In the mode U as the ultra-low humidity mode, the developing frequency is set to fd=2750 (Hz). Thus, in accordance with the environment in which the image forming apparatus is placed, switching is made to an appropriate mode.

By thus making settings, it is possible to perform most appropriate development in each of the environments.

Subsequently, a description will be given of the moire pitch P determined by the relationship between the charging frequency fp and the developing frequency fd in each of the modes.

The largest moire pitch when P<10 (mm) is satisfied in the mode S in the third embodiment is obtained when m=2 is satisfied so that the maximum moire pitch value is Pmax=0.46 (mm).

When Pmax<0.7 is satisfied, the moire pitch is sufficiently low so that no moire image is generated even without the background exposure. Accordingly, the background potential difference is set to Va=0 (V), the first laser power is set to E1=0 (μJ/cm$^2$), and no background exposure is performed. The charging DC voltage V0 is set to −500 (V), similarly to the non-image portion potential Vd.

The maximum moire pitch value Pmax in the mode T in the third embodiment is 0.74 (mm) when in =2 is satisfied. Since P>0.7 is satisfied, to inhibit a moire image, the background exposure is performed. By performing the background exposure, the dark portion potential Vd over the photosensitive drum is smoothed. In the present embodiment, the smallest background potential difference (BG potential difference) needed to inhibit a moire image where the maximum moire pitch value was Pmax=0.74 (mm) was Va=75 (V) and, at this time, the first laser beam amount E1 was 0.05 (μJ/cm$^2$). Accordingly, the first laser beam amount is set to E1=0.05 (μJ/cm$^2$). Also, to provide the non-image portion potential Vd=−500 (V) which is equal to that in the mode S, the DC voltage in the charging voltage is set to V0=−575 (V). When the non-image portion potential Vd is set equal to that in the mode S, an image having an image density equal to that in the mode S is obtained. Thus, in the mode T, the maximum moire pitch value Pmax is larger than in the mode S so that the background potential difference Va is set larger than in the mode S. Consequently, in the mode T, the first laser beam amount E1 as the dose at which the background portion is exposed is set larger than in the mode S and the absolute value of the primary charging potential V0 as the DC voltage output from the charging voltage applying means is set larger than in the mode S. Conversely, in the mode S, the maximum moire pitch value Pmax is smaller than in the mode T so that the background potential difference Va is set smaller than in the mode T. Consequently, in the mode S, the first laser beam amount E1 as the dose at which the background portion is exposed is set smaller than in the mode T and the absolute value of the primary charging potential V0 as the DC voltage output from the charging voltage applying means is set smaller than in the mode T.

The maximum moire pitch value Pmax in the mode U in the third embodiment is 1.23 (mm) when m=2 is satisfied. Since P>0.7 is satisfied and the maximum moire pitch value Pmax is larger than in the mode T, to inhibit a moire image, the background exposure is performed using the first laser power E1 larger than in the mode T. In the present embodiment, the smallest background potential difference needed to inhibit a moire image where the maximum moire pitch value was Pmax=1.23 (mm) was Va=150 (V) and, at this time, the first laser power E1 was 0.10 (μJ/cm$^2$). Accordingly, the first laser power is set to E1=0.10 (p/cm$^2$). Also, to provide the non-image portion potential Vd=−500 (V) which is equal to that in the mode S, the DC voltage in the charging voltage is set to V0=−650 (V). Thus, in the mode U, the maximum moire pitch value Pmax is larger than in the mode T so that the background potential difference Va is set larger than in the mode T. Consequently, in the mode U, the first laser power E1 as the dose at which the background portion is exposed is set larger than in the mode T and the absolute value of the primary charging potential V0 as the DC voltage output from the charging voltage applying means is set larger than in the mode T. Conversely, in the mode T, the maximum moire pitch value Pmax is smaller than in the mode U so that the background potential difference Va is set smaller than in the mode U. Consequently, in the mode T, the first laser power E1 as the dose at which the background portion is exposed is set smaller than in the mode U, and the absolute value of the primary charging potential V0 as the DC voltage output from the charging voltage applying means is set smaller than in the mode U.

Note that the same settings are made with regard also to the modes S and U, though a detailed description thereof is omitted.

A comparative example s is a comparative example in which, in the modes T and U, the background exposure is not performed. In the mode T in the comparative example s, the moire pitch is P>0.70 when m=2 is satisfied and the background exposure is not performed. Consequently, slight potential fluctuations in the charging voltage formed over the photosensitive drum interfered with the developing frequency fd so that a moire image was generated in a half-tone image. In the mode U in the comparative example s also, a moire image having unevenness larger than in the mode T was similarly generated in a half-tone image.

A comparative example t is a comparative example in which, in each of the modes S T, and U, the background exposure was performed using the given first laser power E1=0.10 (μJ/cm$^2$). The comparative example t had a problem to be solved in the optical fatigue of the photosensitive drum when used for a long period of time.

On the assumption that the environment in which the image forming apparatus was used varied under the influence of four seasons and an air conditioner during the long-term use thereof, an experiment was performed in which an image was repeatedly printed on the total of 9000 sheets including the 3000 sheets on which the image was printed in the mode S, the 3000 sheets on which the image was printed in the mode T, and the 3000 sheets on which the image was printed in the mode U, and changes in the bright portion potential V1 of the photosensitive drum and the images were checked.

In the comparative example t, the drum bright portion potential V1 in the initial period of use was −100 (V) but, after consecutive printing on the 9000 sheets, the drum bright portion potential V1 significantly changed to −210 (V). In addition, since the drum bright portion potential was V1=−210 (V), the contrast potential Vc lowered, and the image density lowered. By contrast, in the third embodiment, the drum bright portion potential V1 in the initial period of use was −100 (V), while the drum bright portion potential V1 after repeated printing on the 9000 sheets was −120 (V). Thus, even after the repeated printing was performed also, the drum sensitivity change was small. Since a reduction in the contrast potential Vc was also small, the image density equal to that in the initial period of use was retained.

When a user using the plurality of modes has thus used the image forming apparatus for a long period, by setting the background exposure dose to a smallest needed value in each of the modes, it is possible to output a stable image for a longer period of time, while inhibiting a moire image.

As described above, in the present embodiment, the first laser power E1 as the background exposure dose is set to a smallest needed value in accordance with the maximum moire pitch value Pmax determined by the relationship between the charging frequency and the developing frequency. By thus setting the first laser power E1, it is possible to reduce the optical degradation of the photosensitive drum to minimum, while inhibiting a moire image.

Consequently, it is possible to provide an image forming apparatus capable of more reliably inhibiting the optical fatigue of the photosensitive drum and outputting a stable image for a long period, while inhibiting the interference between the charging frequency and the developing frequency and inhibiting a moire image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-031888, filed on Feb. 26, 2018, which is hereby incorporated by reference herein in its entirety.

What is claimed is:

1. An image forming apparatus comprising:

an image bearing member configured to rotate;

a charging member configured to charge a surface of the image bearing member;

a charging voltage applying portion configured to apply an alternating-current voltage having a predetermined charging frequency to the charging member; and an exposing portion configured to perform image exposure in which a first region of the surface of the image bearing member charged by the charging member is exposed at a first exposure amount for forming an image portion potential, perform background exposure in which a second region of the surface of the image bearing member is exposed at a second exposure amount for forming a non-image portion potential and form an electrostatic latent image at a predetermined resolution on the image bearing member, the second exposure amount being lower than the first exposure amount, wherein a plurality of image forming modes are settable for the image forming apparatus, the plurality of image forming modes are different in at least one of resolution and the charging frequency, and the plurality of image forming modes include image forming modes different in a background potential difference which is a potential difference between a surface potential of the image bearing member after the surface of the image bearing member is charged and before the charged surface is exposed by the exposing portion and a surface potential of a portion of the surface of the image bearing member which has been subjected to the background exposure.

2. The image forming apparatus according to claim 1, wherein, respective moire pitch values at individual dot periods in the electrostatic latent image formed on the image bearing member are each obtained from a moving speed of the surface of the image bearing member, the resolution and the charging frequency, and, when a maximum moire pitch value which is largest among the obtained moire pitch values within a range smaller than a threshold X is larger in one of the plurality of image forming modes than in another thereof, the background potential difference is increased while, when the maximum moire pitch value is smaller in one of the plurality of image forming modes than in another thereof, the background potential difference is reduced.

3. The image forming apparatus according to claim 2, wherein, when the maximum moire pitch value is larger in one of the plurality of image forming modes than in another thereof, the second exposure amount is increased and an absolute value of a DC voltage output from the charging voltage applying portion is increased while, when the maximum moire pitch value is smaller in one of the plurality of image forming modes than in another thereof, the second exposure amount is reduced and the absolute value of the DC voltage output from the charging voltage applying portion is reduced.

4. The image forming apparatus according to claim 2, wherein, when fp (Hz) is the charging frequency, Vp (mm/sec) is the moving speed, and D (dpi) is the resolution, moire pitch values P obtained at n-dot periods (n is an integer of not less than 2) are calculated on the basis of the following expression:

$$P = \frac{Vp}{\left|\frac{D \times Vp}{n \times 25.4} - fp\right|}\text{[mm]},$$

and the maximum moire pitch value is the moire pitch value which is smaller than the threshold X and largest among the respective moire pitch values P obtained at the individual n-dot periods.

5. The image forming apparatus according to claim 4, wherein the threshold X satisfies X≥10.

6. An image forming apparatus comprising:

an image bearing member configured to convey an electrostatic latent image borne thereon at a predetermined moving speed;

a charging member configured to charge a surface of the image bearing member;

a charging voltage applying portion configured to apply an alternating-current voltage having a predetermined charging frequency to the charging member;

a developer bearing member configured to convey a developer borne thereon;

a developing voltage applying portion configured to apply an alternating-current voltage having a predetermined developing frequency to the developer bearing member; and an exposing portion configured to perform image exposure in which a first region of the surface of the image bearing member charged by the charging member is exposed at a first exposure amount for forming an image portion potential and perform background exposure in which a second region of the surface of the image bearing member is exposed at a second exposure amount for forming a non-image portion potential, the second exposure amount being lower than the first exposure amount, wherein a plurality of image forming modes are settable for the image forming apparatus, the plurality of image forming modes are different in either one of the charging frequency and the developing frequency, and the plurality of image forming modes include image forming modes different in a background potential difference which is a potential difference between a surface potential of the image bearing member after the surface of the image bearing member is charged and before the charged surface is exposed by the exposing portion and a surface potential of a portion of the surface of the image bearing member which has been subjected to the background exposure.

7. The image forming apparatus according to claim 6, wherein, when a maximum moire pitch value which is largest among moire pitch values of a moire each resulting from the moving speed, the charging frequency, and the developing frequency within a range smaller than a threshold Y is larger in one of the plurality of image forming modes than in another thereof, the background potential difference is increased while, when the maximum moire pitch value is smaller in one of the plurality of image forming modes than in another thereof, the background potential difference is reduced.

8. The image forming apparatus according to claim 7, wherein, when the maximum moire pitch value is larger in one of the plurality of image forming modes than in another thereof, the second exposure amount is increased and an absolute value of a DC voltage output from the charging voltage applying portion is increased while, when the maximum moire pitch value is smaller in one of the plurality of image forming modes than in another thereof, the second exposure amount is reduced and the absolute value of the DC voltage output from the charging voltage applying portion is reduced.

9. The image forming apparatus according to claim 7, wherein, when fp (Hz) is the charging frequency, fd (Hz) is the developing frequency, and Vp (mm/sec) is the moving speed, respective moire pitch values P calculated for individual natural numbers m in m-th order harmonics of an alternating-current voltage are calculated on the basis of the following expression:

$$P = \frac{Vp}{|fp - m \times fd|}\text{[mm]},$$

where $fp > fd$, or $$P = \frac{Vp}{|m \times fp - fd|}\text{[mm]},$$

where $fp \leq fd$, and the maximum moire pitch value is smaller than the threshold Y and largest among the respective moire pitch values calculated for the individual natural numbers m.

10. The image forming apparatus according to claim 9, wherein the threshold Y satisfies Y≥10.

* * * * *